United States Patent [19]

Green

[11] Patent Number: 4,984,715

[45] Date of Patent: Jan. 15, 1991

[54] TWIN COMPARTMENT SQUEEZE BOTTLE

[76] Inventor: Richard D. Green, 1150 18th St., Ste. 101, Santa Monica, Calif. 90403

[21] Appl. No.: 817,777

[22] Filed: Jan. 9, 1986

Related U.S. Application Data

[63] Continuation of Ser. No. 550,465, Nov. 10, 1983, abandoned.

[51] Int. Cl.[5] ..... B65D 37/00

[52] U.S. Cl. ..... 222/129; 222/212

[58] Field of Search ..... 222/94, 129, 92, 206, 222/212, 215, 481, 482

[56] References Cited

U.S. PATENT DOCUMENTS

| | | | |
|---|---|---|---|
| 2,013,382 | 9/1935 | Garwood | 215/6 |
| 2,166,307 | 7/1939 | Libby | 222/94 |
| 2,661,871 | 12/1953 | Huenergardt | 222/129 |
| 3,076,573 | 2/1963 | Thomas | 222/562 |
| 3,347,420 | 10/1967 | Donoghue | 222/129 |
| 4,148,417 | 4/1979 | Simmons | 222/94 |
| 4,196,808 | 4/1980 | Pardo | 222/129 |

FOREIGN PATENT DOCUMENTS

| | | | |
|---|---|---|---|
| 658291 | 1/1965 | Belgium | 215/6 |

*Primary Examiner*—Michael S. Huppert

*Attorney, Agent, or Firm*—Kelly Bauersfeld & Lowry

[57] ABSTRACT

A twin compartment squeeze bottle is made of plastic material so that the contents of the compartments can be expressed by manual squeezing of the compartments without having to invert the bottle. The compartments are integrally connected by a vertical web and each has its own upper neck outlet and individual cap. The bottom of the compartments are flat so that the bottle is self-standing.

2 Claims, 1 Drawing Sheet

TWIN COMPARTMENT SQUEEZE BOTTLE

This application is a continuation, of U.S. application Ser. No. 550,465, filed Nov. 10, 1983.

FIELD OF THE INVENTION

This invention relates generally to containers and more particularly to an improved twin compartment bottle in which the contents can be expressed by squeezing.

BACKGROUND OF THE INVENTION

Single bottle structures with more than one compartment or chamber are well known in the art. Such bottles are commonly used to house ingredients which might be used together or in sequence. For example, one compartment in the bottle could hold shampoo while the other compartment held hair conditioner. In other instances, the ingredients might constitute chemicals to be used together but normally held in a separated state until such actual use. An example would be epoxy glues wherein a resin and catalyst are initially held in separate compartments but then mixed when they are to be used.

Representative examples of twin compartment bottles used over the years are shown, for example, in U.S. Pat. Nos. 2,013,382 issued Sept. 3, 1935 to Garwood; 3,076,573 issued Feb. 5, 1963 to Thomas; and 4,196,808 issued Apr. 8, 1980 to Pardo. The containers in each of these patents constitute hard material such as glass so that in order to express the contents, the bottles must be tilted. The specific inventions in the patents relate mostly to the closure members for the compartments themselves.

BRIEF DESCRIPTION OF THE PRESENT INVENTION

With the foregoing in mind, the present invention contemplates the provision of an improved twin compartment bottle wherein the contents can be expressed by squeezing the compartment without having to invert the bottle.

In its preferred embodiment, the bottle comprises an integral body of flexible plastic material defining first and second compartments in side-by-side relationship integrally connected by a vertical web. Each compartment has its own upper neck outlet with a closure device. When the closure of a compartment is removed, the ingredients in the compartment can be expressed through its neck outlet by manual squeezing of the compartment without having to invert the bottle. The bottom surfaces of the compartments are flat and coplanar to that the bottle is self-standing.

BRIEF DESCRIPTION OF THE DRAWINGS

A better understanding of this invention will be had by referring to the accompanying drawings in which.

DETAILED DESCRIPTION OF THE PREFERRED EMBODIMENT

Figure 1:
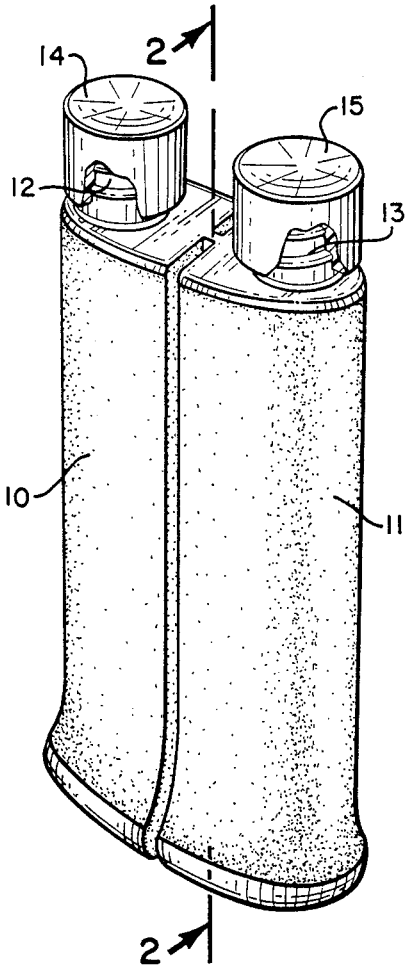
FIG. 1 is a perspective view partly broken away showing the improved twin compartment squeeze bottle of my invention.

Referring first to FIG. 1, the twin compartment squeeze bottle comprises an integral body of flexible plastic material defining first and second compartments 10 and 11 in side-by-side relationship integrally connected by a vertical web W. Each compartment has an upper neck outlet as indicated in the broken away portion at 12 and 13 respectively. Appropriate closures in the form of screw caps 14 and 15 are provided on these neck outlets for the respective compartments. The bottoms of the compartments are flat and coplanar as best seen in FIG. 2 so that the bottle is self-standing.

Figure 2:
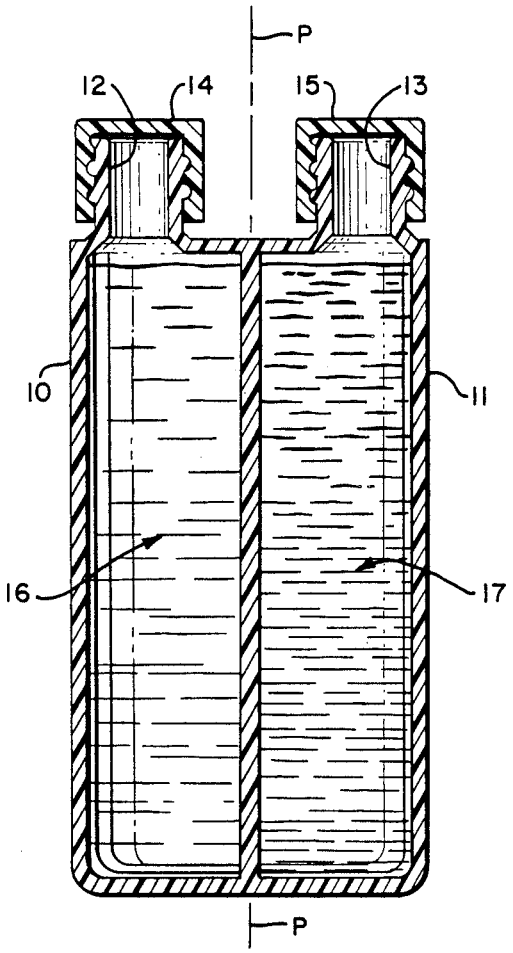
FIG. 2 is a cross section taken in the direction of the arrows 2—2 of FIG. 1; and, FIGS. 3 and 4 are perspective views of different sized bottles illustrating examples of ingredients being expressed from the compartments.

Referring to the cross section of FIG. 2, the compartment 10 may hold an ingredient 16 and the compartment 11 hold a different ingredient 17. As an example, and as has characterized prior twin compartment bottles, the ingredient 16 might be shampoo and the ingredient 17 hair conditioner.

In the foregoing event, the shampoo 16 can first be expressed by removing the cap 14 and simply squeezing the shampoo out without having to actually invert the bottle. This feature would be desirable in the event the other cap 15 were lost and if it were desired only to obtain the ingredient 16 without losing any of the ingredient 17, which latter situation would occur if the bottle were tilted to express the contents by gravity.

After the ingredient 16 has been used, the cap 14 can be replaced and the cap 15 removed and the hair conditioner then used. Again, the contents can be expressed by simply squeezing the plastic material making up the compartment.

Figure 3:
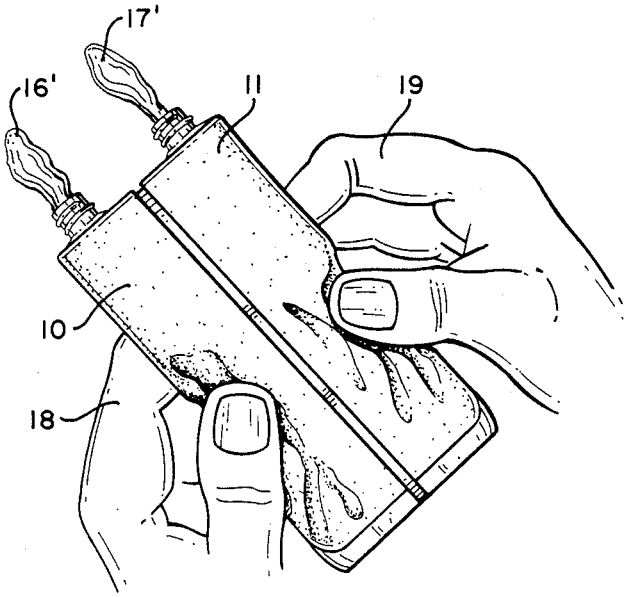

FIG. 3 illustrates an actual example of the manner of expressing the ingredients without having to invert the bottle and rely on gravity flow. In the example illustrated in FIG. 3, the compartments 10 and 11 contain special chemicals shown expressed from the neck portions at 16' and 17'. In this instance, the chemicals are to be maintained separate from each other until such time as they are actually to be used. It is further assumed that the chemicals when they are used are to be mixed together in a proportion of approximately 1 to 1.

With the bottle of the present invention, the expressing of the ingredients and proper proportionate mixing thereof can readily be accomplished by simply removing both caps and expressing the ingredients simultaneously by manually squeezing the first and second compartments 10 and 11 at the same time and with approximately equal pressures. The squeezing action is illustrated by a person's hands 18 and 19 engaging the compartments 10 and 11 respectively.

Where chemicals are to be combined when used in a 1 to 1 ratio, then the preferred configuration for the twin compartment bottle would be one in which the compartments constitute mirror images of each other on either side of a vertical plane, passing between the two compartments to longitudinally bisect the Web W. Referring back to FIG. 2, such vertical plane is depicted by the vertical line P—P and it will be noted that the compartments constitute mirror images of each other on either side of this plane. Thus, the compartments have identical volumes and are therefore ideal for chemicals to be mixed when used in a 1 to 1 proportion.

Figure 4:
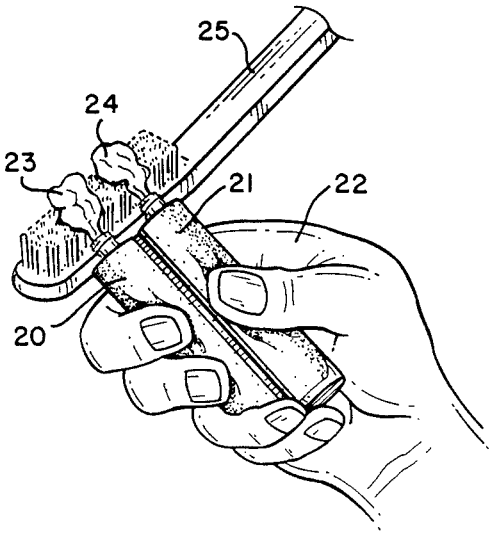

FIG. 4 shows a smaller bottle having equal volume compartments 20 and 21 for holding respectively a hydrogen peroxide gel and a baking soda-fluoride gel useful in cleaning teeth. It is important that these chemicals be kept separate until they are actually to be used. Because of the smaller bottle configuration, both chemicals can be expressed simultaneously in approximately a 1:1 ratio using only one hand 22 as shown. In the example, the two chemicals are shown at 23 and 24 being applied directly onto a toothbrush 25, the manual squeezing of the compartments being done at the same time and in a manner to collapse the compartments by approximately equal amounts.

From all of the foregoing, it will now be evident that the present invention has provided a greatly improved twin compartment bottle wherein the contents can readily be expressed either individually or together without having to invert the bottle.

It is also known to make twin compartment bottles of plastic material so that the contents can be expressed by squeezing such as shown in U.S. Pat. No. 4,148,417 issued Apr. 10, 1979 to Simmons.

I claim:

1. A twin compartment bottle comprising an integral body of flexible plastic material defining first and second compartments constituting substantially mirror images of each other on opposite sides of a vertical plane and having adjacent walls in side-by-side relationship integrally connected by a central vertical web, said adjacent walls of said compartments extending outwardly in opposite directions from said web in closely spaced nondiverging relation whereby said walls cooperate with each other and with said web to support the bottle in a stable manner in a self-standing upright position, each compartment having an upper neck outlet and a separate removable closure for said outlet, the bottoms of said compartments being generally flat and coplanar so that said bottle is self-standing whereby the closure of a compartment can be removed and the ingredient in said compartment expressed through its neck outlet by manual squeezing of the compartment without having to invert the bottle.

2. A twin compartment squeeze bottle according to claim 1 wherein said closure for each compartment comprises a threaded cap.

* * * * *